United States Patent [19]

Kaplan

[11] Patent Number: 4,860,564

[45] Date of Patent: Aug. 29, 1989

[54] METHOD AND APPARATUS FOR TAPER ROLLING CONTROL FOR A ROLLING MILL

[75] Inventor: Naum M. Kaplan, Pittsburgh, Pa.

[73] Assignee: United Engineering, Inc., Pittsburgh, Pa.

[21] Appl. No.: 99,216

[22] Filed: Sep. 21, 1987

[51] Int. Cl.[4] ..... B21B 37/14

[52] U.S. Cl. ..... 72/19; 72/8; 72/11; 72/14; 72/20; 72/240; 72/245

[58] Field of Search ..... 72/8, 10, 11, 19, 14, 72/15, 16, 20, 240, 241, 234, 245

[56] References Cited

U.S. PATENT DOCUMENTS

| | | | |
|---|---|---|---|
| 3,380,277 | 4/1968 | Mulflur | 72/200 |
| 3,906,764 | 9/1975 | Mueller | 72/8 |
| 4,126,026 | 11/1978 | Fapiano | 72/6 |
| 4,555,922 | 12/1985 | Ginzburg | 72/229 |

FOREIGN PATENT DOCUMENTS

| | | | |
|---|---|---|---|
| 0045206 | 4/1981 | Japan | 72/241 |
| 0142708 | 9/1982 | Japan | 72/234 |

OTHER PUBLICATIONS

Wright, H., "The Hydraulic Position Controlled Mill and Automatic Gauge Control", *Steel Times International*, Mar., 1979.

Wright, H., "Applications and Advantages of Hydraulic AGC", *Iron and Steel International*, Dec., 1978.

Dendle, D. W., "Hydraulic Position-Controlled Mill and Automatic Gauge Control", *Flat Rolling-A Comparison of Rolling Mill Types, Proceedings*, University College, Cardiff, Sep. 26-29, 1978, pp. 103-111.

*Primary Examiner*—Lowell A. Larson
*Assistant Examiner*—Steven B. Katz
*Attorney, Agent, or Firm*—Parmelee, Miller, Welsh & Kratz

[57] ABSTRACT

A method and apparatus for rolling a taper in or out of a strip during reduction by a rolling mill, rolling a first portion of the strip by employment of a gaugemeter roll gap control system using a first value for the mill stretch above the natural mill stretch value for the mill and which value during the rolling of the first portion will be a fixed value, thereafter rolling a second portion of the strip in the same rolling operation by using a value for the mill stretch in the gaugemeter roll gap control system which will vary to effect a change in the roll gap and hence a change in reduction of the strip in which the second value may be a linear function.

6 Claims, 2 Drawing Sheets

METHOD AND APPARATUS FOR TAPER ROLLING CONTROL FOR A ROLLING MILL

BACKGROUND OF THE INVENTION

In the process of producing strip and plate in a rolling mill the temperature of the rolled material is a very important consideration from a gauge, physical and quality standpoint, the latter including uniformity, shape and flatness. One aspect of material temperature has to do with the temperature rundown in the material (bar) rolled in the hot mill, whether in a reversing mill, semi-continuous, or continuous mills. Because the trailing end portion of the hot bar is normally subject to considerable greater heat losses while it waits to be rolled and while it is exposed to the atmosphere compared with the earlier portion to be rolled, the bar has a temperature gradient decreasing from the leading end to the trailing end. While this gradient is generally linear, certain portions of the affected area are not. This temperature gradient develops a progressively greater roll force for a given desired rolled gauge. In order to attempt to compensate for this condition many and varied corrective procedures have been put in practice and/or suggested.

These attempts has sought both to treat the bar before it is finally rolled, for example, in a reversing hot mill or during the rolling of the bar as in the finishing train of a continuous hot mill. Examples of the former are delay tables, coil boxes and temperature control devices which are employed to equalize or reduce the temperature gradient before the final rolling pass. Examples of the latter are mill gauge control, mill speed control and mill temperature control systems such as interstand cooling.

None of the prior art systems when used singly or in combination with one or more of the other systems have been totally successful. Moreover, some of the more successful ones represent a considerable outlay in capital investment and operational expense and maintenance.

SUMMARY OF THE INVENTION

It is therefore, an object of the present invention to provide an improved method and apparatus for minimizing the adverse affects of bar temperature gradient in hot rolling of strip and plate.

It is a further object to provide an improved gauge control system for a hot rolling mill which will automatically impart a control taper to the whole or a selective portion of the bar commensurate with the temperature gradient thereof to minimize the gradient from adversely affecting the desired ultimate gauge to which the bar is rolled in the hot mill or a later mill.

These objects are obtained by use of a gaugemeter roll gap control system for the mill, wherein the factor employed in the control for the stretch or spring compensation of the mill for a given pass is varied as a predetermined function to effect a change in the roll gap to roll a controlled tapered condition in the rolled product.

These, and other objects more particularly are obtained by the present invention by providing a method and apparatus comprising the means and steps of passing the material through the roll gap of a stand of a mill to produce a controlled reduction in the material, during this reduction adjusting the roll gap as a function of the change in roll force to compensate for at least some of a change in the roll gap due to mill stretch according to the mill spring curve for the stand, said function being represented by a spring compensation value between a value representing the natural stiffness of the mill and a value representing compensation for the total spring of the mill, thereafter and at a selected point along the material as it is being rolled making a series of related additional adjustments of the roll gap as a function of a change in roll force during the rolling of such portion of the material, the second function being represented by a mill spring compensation value which will vary to effect the additional adjustments to cause a further controlled change in reduction of the material.

BRIEF DESCRIPTION OF THE DRAWINGS

The above advantages, as well as other features and advantages, of the present invention will be better appreciated when the following description of the preferred embodiment of the present invention is read along with the accompanying drawings of which.

DESCRIPTION OF THE PREFERRED EMBODIMENT

Figure 1:
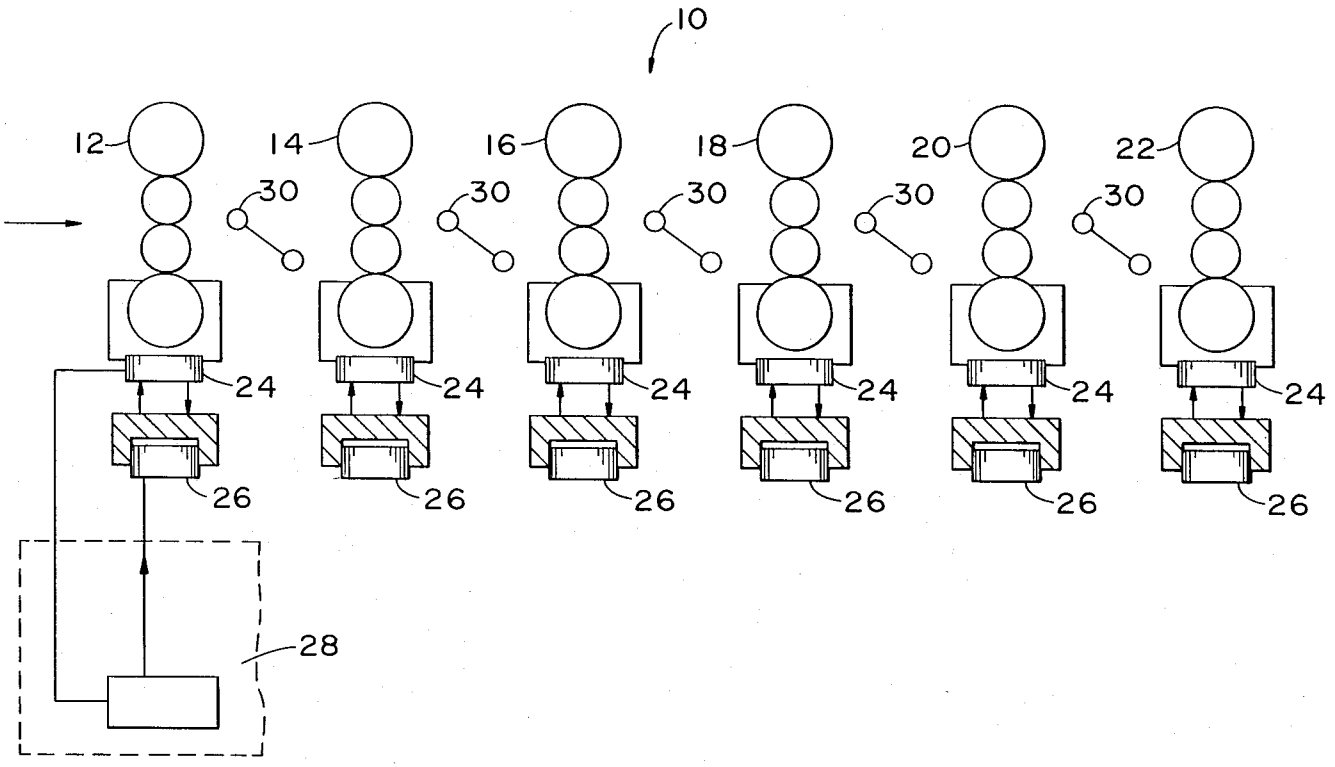
FIG. 1 is a schematic elevational view of a finishing train of a hot strip mill incorporating the features of the invention.

Before referring to the drawings it is deemed desirable to comment on certain present day gauge control systems for rolling mills and systems for correcting for bar temperature rundown to the extent they interrelate. These systems are described and discussed in the following U.S. Patents and Publications: U.S. Pat. Nos. 3,380,277, 3,906,764, 4,126,026 and 4,555,922—Publications: The Hydraulic Position Controlled Mill and Automatic Gauge Control—"Steel Times International":; by H. Wright, March 1979, Applications and Advantages of Hydraulic AGC., "Iron and Steel International":, by H. Wright, December 1978, Hydraulic Position-Controlled Mill and Automatic Gauge Control, published in: "Flat Rollings—A Comparison of Rolling Mill Types, Proceedings", by D. W. Dendle, at an International Conference, held at University College, Cardiff, Sept. 26–29, 1978, P. 103–111. Additional Background information on taper rolling is found in U.S. Pat. Nos. 3,081,652 and 3,081,653.

The origin of the "Gaugemeter" system for rolling mills may in part be traced to U.S. Pat. Nos. 2,726,541 and 2,680,978 referred to in column 1 of the aforesaid U.S. Pat. No. 4,126,026. It was not until the development of improved hydraulic systems and electric controls that the gaugemeter found acceptance in the rolling mill industry.

The 4,126,026 and 4,555,922 patents describe an early form of the gaugemeter system involving a "lock-on" concept in which certain improvements were suggested in what was referred to as a "absolute lock-on" system, this system being described in Pat. No. 3,906,764. In both of these "lock-on" systems an actual roll force signal is employed and a comparison made with a reference "lock-on" signal, whether an original or updated one to determine the amount of roll gap correction that must be made to compensate for mill stretch or spring at a particular instant of rolling.

A later gaugemeter system which may be referred to an "absolute gauge system" did away with the "lock-on" principal and the requisite comparison step by providing a system for calculating the instantaneous mill stretch for each time increment of material being rolled. A description of this may be found in the above referred to article by D. W. Dendle entitled "The Hydraulic Position Controlled Mill and Automatic Gauge Control", page 106.

In considering the above comments in relationship to the temperature rundown condition in rolling hot strip or plate, the patent art identified contains at least three suggestions to correct for the condition which are believed self-evident, one suggests to roll a reverse taper in the bar before it is rolled in the finishing passes, the second to roll out the taper that would be otherwise formed in the finishing passes by use of a "absolute lock-on" system and the third by taper rolling the trailing end of the bar in one of the earlier passes of the finishing passes.

It will be observed that the most recent of the "taper" rolling systems rely on the "lock-on" system as a fundamental part of their controls and while this may represent an improvement over the earlier attempts it still suffers from the well known limitation of the "lock-on" systems. Of particular concern is the gauge error problem of the original "lock-on" systems.

With the foregoing in mind, and with reference to FIG. 1 there is shown the outline of a finishing train 10 of a continuous hot strip mill designed to produce the usual hot strip mill carbon and alloy steel products. The train consists of six tandemly arranged stands 12, 14, 16, 18, 20 and 22. The train and its individual stands may be constructed and operated according to well known practice which need not be described to understand the present invention. FIG. 1 does show, however, the usual load cells 24, hydraulic roll gap control cylinder 26 and the outline of the operator's control console 28 which is understood to be part of the usual mill computer system. FIG. 1 also indicates the employment of customary interstand loopers at 30.

Figure 2:
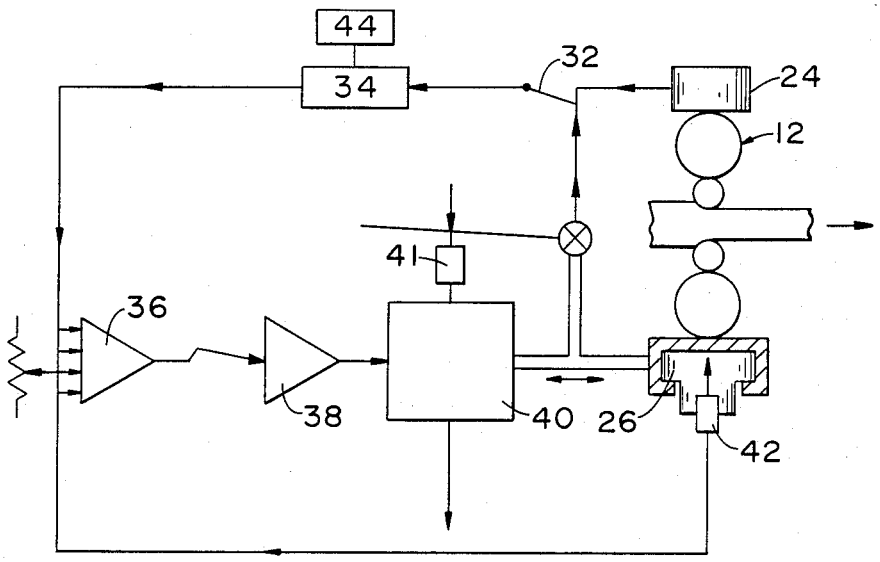
FIG. 2 is a schematic view of an automatic gauge control system for one of the earlier stand of the mill train shown in FIG. 1.

In FIG. 2 a familiar automatic gauge control of the gaugemeter type is illustrated including the mill stand 12. The load cell 24 for simplicity is shown at the top of the stand instead of at the bottom as shown in FIG. 1. FIG. 2 also shows the hydraulic roll gap control cylinder 26. It will be appreciated that each stand will have two housing posts to which will be associated separate load cells, cylinders and other cooperative control components to be identified.

The load cell 24 feeds an electrical signal representing the instantaneous roll force to a switch 32 which when closed sends a roll load or force signal to a mill spring function generator 34, the signal of which is received by a position control amplifier 36. This amplifier sends its signal to a power amplifier 38 which feeds a signal to a electrohydraulic servovalve 40, the valve in turn controlling the flow of fluid i.e. pressure to the roll gap control cylinder 26. The signal from the amplifier 36, as will be explained later, is a combined signal with other input signals.

The control system, being a closed loop type, has several feed back circuits to the control amplifier 36, one being provided by a pressure transducer 41 and one by a position transducer 42, the transducer 41 feeding to the switch 32 and the transducer 42 to the control amplifier 36.

The control amplifier 36 receives still other usual signals such as a gauge reference signal, a gauge monitor signal, etc. The signal to initiate the taper rolling mode, which can be introduced automatically or manually by an electrical element, not shown, is accomplished by a second function generator 44. As noted, except for the addition of the taper rolling mode, the control system is well known as well as the components used which are more fully shown and described in the prior art publications noted above.

As previously noted, the present invention provides a system for changing the normal value of the gaugemeter control representing the mill spring factor during a given pass, the normal value being introduced in the control for rolling a constant or uniform gauge. This constant gauge value is normally set as a fixed value to increase the stiffness of the mill stand greater than the natural value of the stand but less or equal to compensation for total mill spring, i.e. infinite stiff mill. The desired stiffness value or setting is selected to give the desired compensation of mill stretch, the constant being based on the amount of compensation desired for the spring of the stand which in the use of the gaugemeter control for a given pass in previous forms was held fixed. The basic relationships and mathematical derivations of the gaugemeter control and particularly the functions and relationships the mill spring plays in the operation of the mill and the control is fully discussed and developed in prior art publications some of which are identified above and for which reason they will not be repeated here other than in the particular context of the present invention.

In order to improve and simplify the taper rolling mode the present invention provides a way and means for changing the mill stand stiffness value, preferrable as a linear function, to roll a taper in the bar or roll out a taper either along its entire length or at a selected point along the length of the bar. The basic principle behind this concept may be better understood from the following equation:

$$G = h - \frac{[Fact \times \alpha + Fant\,(1 - \alpha)] \times \beta}{MS}$$

where:

G=Gap reference for the pass h=target exit strip thickness for the pass

Fact=actual roll separating force during the pass

Fant=anticipated roll separating force for the pass

MS=mill spring $\alpha$=mill stiffness multiplier $\beta$=taper multiplier.

Figure 3:
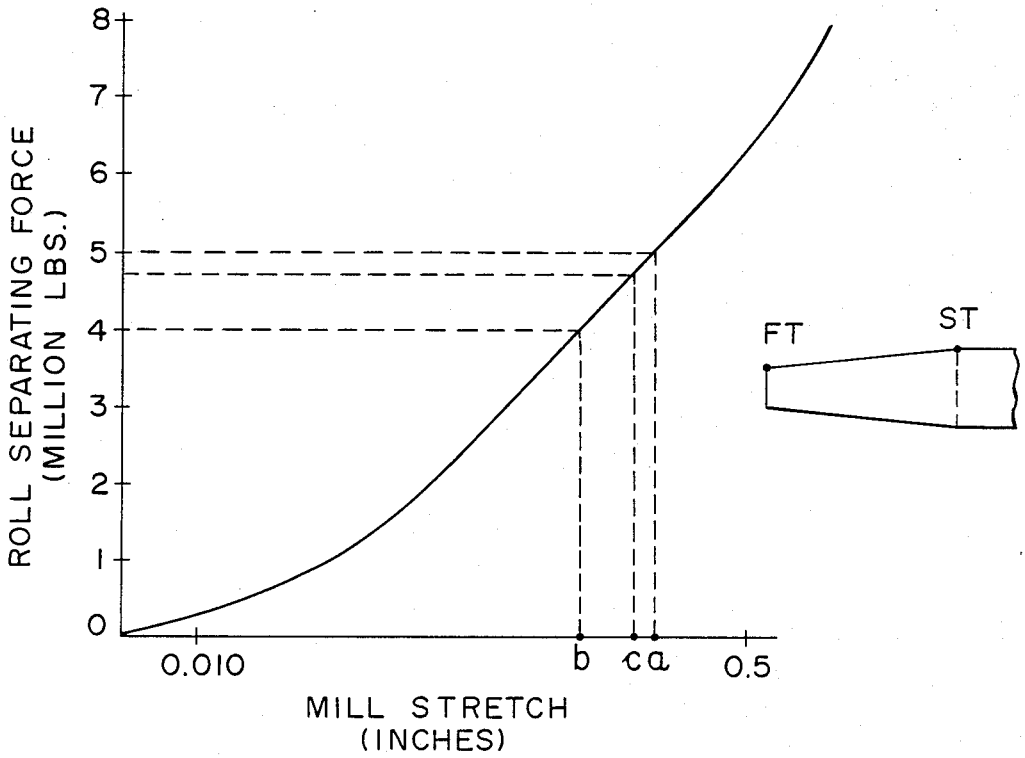
FIG. 3 is a graph illustrating the roll force vs. mill stretch curve for a given strip or plate which includes a non-taper rolling phase i.e. a or b and a tapered rolling phase i.e. between b and c.

It will be appreciated that this equation is similar to the general instantaneous gaugemeter equation practiced by more recent forms of the gaugemeter control. The general equation has been modified in an important respect by the addition of the multiplier $\beta$ designed to change linearly, for example, from a factor of 1 to a factor of 1.2 at or during predetermined distances along the length of the bar where it is desired to taper roll. The normal range that will be available for $\beta$ in a usual mill, i.e. between the natural mill stiffness and compensation for total mill stiffness and an amount slightly beyond, for example, as noted above where $\beta$ exceeds total stiffness compensation by a multiplication factors of 1 to 1.2 should suffice to give the required taper range. It will be appreciated that in a multipass rolling schedule, the earlier passes may employ a higher $\beta$ value, while in later passes a lower $\beta$ value may be used. Moreover, the value for $\beta$ may be greater than the 1.2 value given above, depending on the capacity of the mechanical equipment i.e. cylinder 26 and the degree of stability of the control system. In a tandem mill where the final pass is to produce a constant and desired gauge, the taper rolling more will preferrably take place in one or more of the earlier stands, whereas in a single stand reversing mill it will be performed either during the penultimate or an earlier pass. The point of initiation may be carried out by several well known technics such as measuring the length of the bar at two or more given points during the rolling process. FIG. 3 illustrates for a given strip the change in mill spring from the non-taper rolling phase indicated by point (a) on the curve and the taper rolling phase indicated by point (b) on the curve.

FIG. 3 will also allow a better understanding of the taper control system of the present invention and its inter-relationship to the gauge-meter system for rolling constant and desired gauge when the following outline of a simplified example of a mill set up of a simplified rolling procedure is considered:

(1) Pre-set: Fact=0; $\alpha$=0; Fant=0 Gap=h−-(Fant/MS), per point (a) on the graph.

(2) Rolling; Fact−[Fact<Fant]; $\alpha$=1; $\beta$=1 No Taper. Gap=h−(Fact×$\beta$/MS), per point (b) on the graph.

(3) Rolling with taper:

(3a) the tail end point FT on the bar, $\beta$=1.2; assuming Fact=constant Gap=h−(Fact×$\beta$/MS) per point (c) on graph.

(3b) between points ST and FT on the bar $\beta$ changes from 1 to 1.2 on a ramp, during which time the mill stretch compensation is changed between points (b) and (c) on the graph.

In addition to the temperature taper rolling mode, the present invention may be employed, however, where it is desired to roll a condition in the bar in a given pass where predetermined changes in the mill stiffness compensating factor can be used to advantage such as to obtain final rolled taper in the bar. Also it will be appreciated that the concept of changing the mill stiffness compensation factor for the stand in a given pass can be employed in other forms of gaugemeter systems, such as the several types of "lock-on" systems. Also the bar can be rolled with its leading end having a lead in gradual increasing thickness and thereafter the bar can be rolled either to give a uniform constant desired gauge and/or a trailing taper having a gradual decreasing thickness to a desired trailing end thickness, the latter in each alternate case compensating for the temperature rundown condition in the bar. When rolling the increasing thickness product or portion of the strip $\beta$ may assume values less than 1 where $\alpha$ may be any value between 0 and 1. Where $\alpha$ is such, when a decreasing thickness product or portion of strip is being rolled $\beta$ may assume a value greater than 1. In this connection in referring to the equation above wherein $\alpha$ is 1 and $\beta$ is less than 1 the product will be rolled thicker and when greater than 1 it will be rolled thinner than when $\beta$ is less than 1, assuming everything else is constant.

While the present invention has been described in connection with a rolling mill and for rolling hot material, it will be appreciated by those skilled in the art that the invention can be employed in other processing apparatuses and other rolling procedures.

What I claim is:

1. A method for operating a rolling mill for producing metal strip-like material having at least a portion with a thickness taper in the direction of rolling and in which the mill has one or more stands each including a roll gap, comprising the steps of:

(a) passing the material through a roll gap of a stand of the mill to perform a reduction of the material, (b) during the reduction of a first portion of the material adjusting the roll gap as a function of a change in the roll force to compensate at least for some of a change in said roll gap due to mill spring according to the mill spring curve for the stand, said function being represented by a selected first value greater than the natural stiffness value of the stand but less than or equal to the value representing compensation of the total spring of the stand, (c) at a selected point during the rolling of the first portion making an additional adjustment of said roll gap as a function of the change in roll force during the rolling of a second portion of the material to compensate at least for some of a change in said roll gap due to mill spring according to the mill spring curve for the stand, said function of step (c) being represented by a value different from said selected first value to cause a further controlled change in reduction of the material to roll said taper condition in the material, said functions performing according to the following relationship:

$$G = h - \frac{[Fact \times \alpha + Fant\,(1 - \alpha)] \times \beta}{MS}$$

wherein:

G=gap reference for the pass h=target exit strip thickness for the pass

Fact=actual roll separating force during the pass

Fant=anticipated roll separating force for the pass

MS=mill spring $\alpha$=mill stiffness multiplier for said first function (said first value)

$\beta$=taper multiplier for said predetermined function (said different value).

2. A method for operating a rolling mill according to claim 1, wherein said function of step (c) is a value greater than the maximum value of said selected first value.

3. A method for operating a rolling mill according to claim 1, the additional steps of:

controlling the additional adjustment of said roll gap by causing said function of step (c) to be a linear progressive increasing value to thereby impart a decreasing taper to the material from said selected point.

4. In a rolling mill for producing a metal strip-like material, in which the mill has one or more stands each of which includes a roll gap, (a) means for adjusting a roll gap of a stand of the mill during the rolling of a portion of the material as a function of the change in roll force to compensate at least for some of a change in said roll gap due to mill spring according to the mill spring curve for the stand, said function being represented by a selected first value greater than the natural stiffness vlaue of the mill but less than or equal to a value representing total compensation for the spring of the mill, and (b) means operative at a selected point during the rolling of the first portion of the material for making an additional adjustment of said roll gap as a function of a change in the roll force during the rolling of a second portion of the material to compensate at least for some of a change in said roll gap due to mill spring according to the mill spring curve for the stand, said function of part (b) being represented by a value different from said selected first value to cause a controlled change in reduction of the material; with said means for causing said adjustment of said change of the roll gap being controlled of the following relationship:

$$G = h - \frac{[Fact \times \alpha + Fant\,(1 - \alpha)] \times \beta}{MS}$$

wherein:

G=gap reference for the pass
h=target exit strip thickness for the pass
Fact=actual roll separating force during the pass
Fant=anticipated roll separating force for the pass
MS=mill spring
$\alpha$=mill stiffness multiplier for said first function (said first value)
$\beta$=taper multiplier for said predetermined function (said different value).

5. In a rolling mill according to claim 4:
including means for causing said function of part (b) to be a linear progressive increasing value to thereby impart a decreasing taper to the material from said selected point.

6. In a rolling mill according to claim 4:
including means for making said function of part (b) a value greater than the maximum value of said selected first value.

* * * * *